United States Patent [19]

Morandini

[11] Patent Number: 4,887,316

[45] Date of Patent: Dec. 19, 1989

[54] HOOD-TYPE GARMENT

[76] Inventor: Rose P. Morandini, 8214 21 Mile Rd., Utica, Mich. 48087

[21] Appl. No.: 313,094

[22] Filed: Feb. 21, 1989

[51] Int. Cl.[4] ..... A42B 1/04

[52] U.S. Cl. ..... 2/174; 2/202; 2/4

[58] Field of Search ..... 2/4, 5, 410, 418–419, 2/174, 202

[56] References Cited

U.S. PATENT DOCUMENTS

| | | | |
|---|---|---|---|
| 853,012 | 5/1907 | Grumbar | 2/202 XR |
| 1,996,367 | 4/1935 | Davis | 2/174 |
| 143,610 | 1/1946 | Maxwell et. al. | 2/202 XR |
| 2,436,249 | 2/1948 | Clement | 2/174 XR |
| 2,445,487 | 7/1948 | Lester et. al. | 2/174 |
| 2,484,269 | 10/1949 | Carlson | 2/174 |
| 2,870,451 | 1/1959 | Brodsky | 2/202 |
| 3,916,917 | 11/1975 | Hubbert | 2/174 X |
| 3,929,143 | 12/1975 | Coleman | 2/174 X |
| 4,173,042 | 11/1979 | Krzewinski-Morris | 2/174 X |
| 4,190,907 | 3/1980 | Gruickshank | 2/202 |
| 4,457,027 | 7/1984 | Gladstone | 2/174 |
| 4,554,683 | 11/1985 | Wong | 2/202 |
| 4,665,567 | 5/1987 | Dilger | 2/174 |
| 4,698,853 | 10/1987 | Walton | 2/174 |
| 4,710,756 | 12/1987 | Thornburg et al. | 2/202 X |
| 4,722,100 | 2/1988 | Greer | 2/174 |

*Primary Examiner*—Steven N. Meyers
*Assistant Examiner*—Jeanette E. Chapman
*Attorney, Agent, or Firm*—Arnold S. Weintraub

[57] ABSTRACT

A hood-type garment for enclosing the head and face for protecting hair and makeup during dressing. The garment is a mesh-type fabric and has a zipper, Velcro ® or tape closure to facilitate egress and ingress. An elastic band is attached to the base of the hood, the band encircling the neck of the wearer to secure the hood about the head and face of the wearer.

6 Claims, 1 Drawing Sheet

HOOD-TYPE GARMENT

BACKGROUND OF THE INVENTION

1. Field of the Invention

This invention concerns a protective covering for the face and hair to protect makeup and hair of the user.

2. Prior Art

The prior art teaches a variety of hood-type head coverings for head and clothing protection. One example is U.S. Pat. No. 2,447,561 to Brenner which teaches a head covering which ties about the neck and face.

U.S. Pat. No. 3,505,678 to Key teaches a hood for protecting the wearers' hairdo. The hood covers the head and face and is held in place by means of binding tape stitched to the edges of the hood.

U.S. Pat. No. 1,902,441 to Giuliano comprises an open piece of fabric which may be folded to encompass the head and face of the wearer for use as a protected head covering. The covering is then tied into place about the neck of the wearer.

U.S. Pat. No. 2,477,437 to Borowick teaches a clothes protecting head covering which comprises a hat-like first piece and a veil-like second piece which covers the face leaving the back of the hair exposed. U.S. Pat. No. 2,064,032 to Roberts, defines a triangular piece of material which is folded about the face and head to form a protective head covering and is then tied into place.

The prior art does not teach a protective head covering having a simplified closure means and elasticized neck band.

SUMMARY OF THE INVENTION

The present invention, generally, provides a hood-type garment for protecting hair and makeup which comprises:

(a) a first generally rectangular piece of material, the ends of the rectangle being releasably joined to form a generally cylindrical shape for placement about the face and hair of a user;

(b) a second piece of material which is joined at the edges thereof to the first piece to form a top section;

(c) means for releasably joining and disengaging the ends of the first piece of material at the point at which they are joined to each other;

(d) means for tightening a lower edge of the first piece toward a central point.

The fabric of the hood may be a loose or mesh-type fabric through which the user may breath when placed over the user's face. The means for disengaging the cylindrical section of the hood is easily releasable, to eliminate the need for tying the garment about the face and neck of the wearer.

The garment is worn by placing the cylindrical portion of the garment about the face and head of the wearer and engaging the means for releasably joining the ends of the first piece at the point at which they are joined.

For a more complete understanding of the present invention, reference is made to the following detailed description and accompanying drawing. In the drawing, like reference characters refer to like parts throughout the several views, in which:

DESCRIPTION OF THE PREFERRED EMBODIMENT

Figure 1:
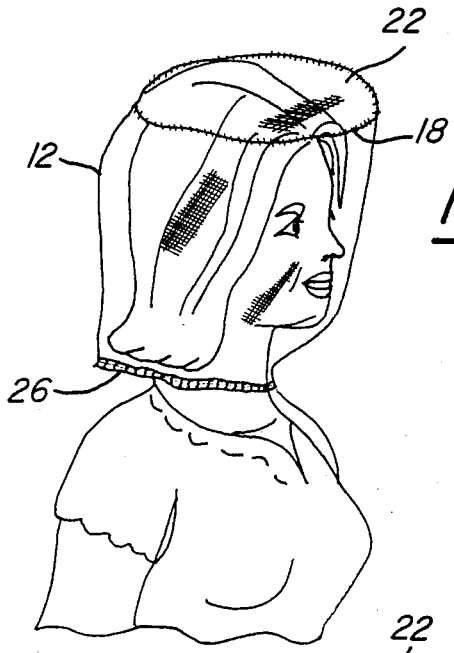
FIG. 1 is a perspective view of a hood-type garment in accordance with the present invention.
Figure 2:
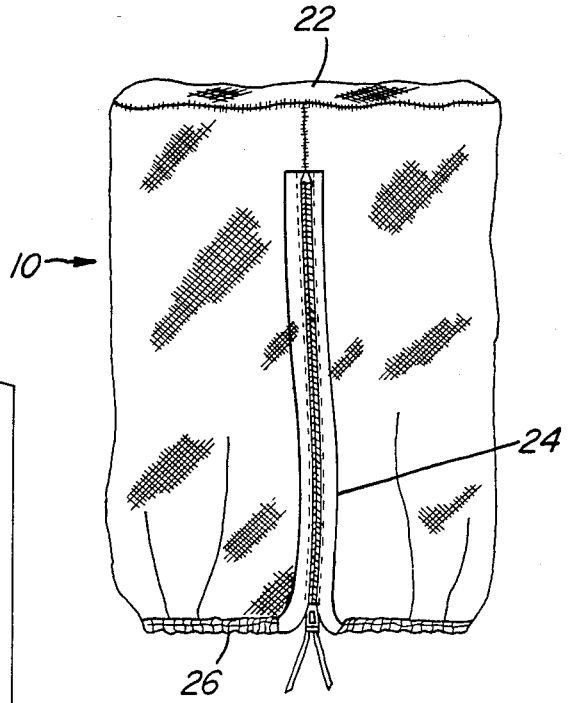
FIG. 2 is a perspective view of the garment hereof as seen from the the rear of the garment.
Figure 3:
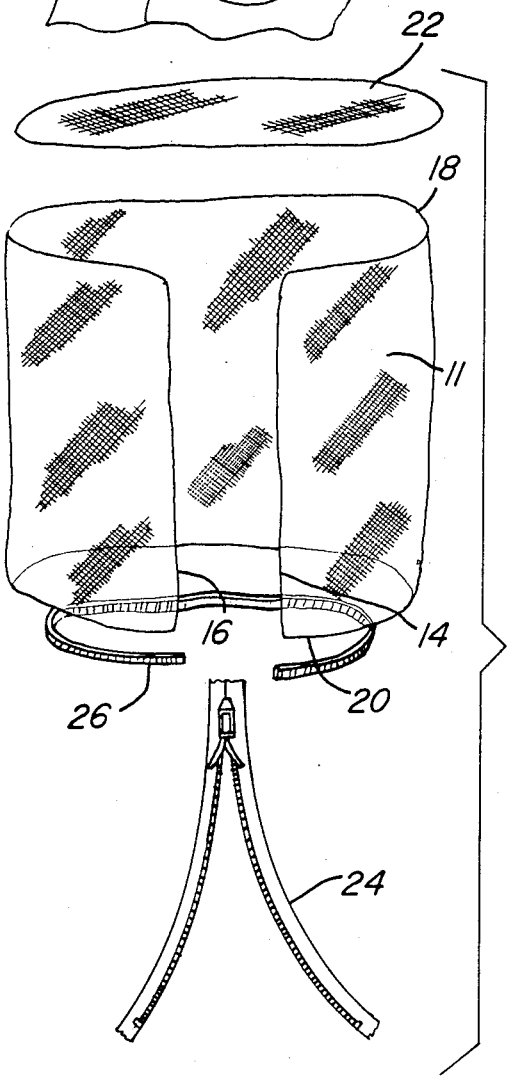
FIG. 3 is an exploded view of the pieces of the garment.

Now, and with reference to the drawing, and as shown in FIG. 1, the hood 10 hereof, generally, comprises a first generally rectangular piece of material 11, having a first end 14 and a second end 16, an upper edge 18, and a lower edge 20. The first and second ends of the rectangle 14, 16, are joined together to form a generally cylindrical shape for placement about the face and hair of a user.

A second piece of material 22 is joined to the upper edge of the first piece to form a top section. The second or top piece 22 is, generally, circular in shape and is adapted to close of the top of the hood 10.

The hood-type garment comprises a material of generally loose weave or mesh fabric. The weave of the material is such that the weave permits the wearer to breath easily through the fabric when the fabric surrounds the face. Such a fabric may be any suitable synthetic or natural fiber. The second piece of material is of the same fabric as the first. The second piece of material is joined to the first by means such as sewing, gluing or heat treatment. The second piece of fabric forms the top of the hood-type garment when the hood or garment 10 is fitted over the top of the head.

Attached to the first end 14 and second end 16 of the first rectangular piece 11, is a means 24 for releasably joining the first end and second ends 14, 16. Attached to the lower edge 20 of the rectangular piece is a means 26 for tightening a lower edge of the first piece toward a central point.

The means 24 for releasably joining the first and second ends 14, 16 of the rectangular piece 11 may comprise any easily releasable means. The preferred engaging and disengaging or closure means is a fastener such as a zipper. Other suitable fasteners such as, buttons, snaps, hook and loop fasteners Velcro® or a re-sealable tape may also be used.

The means 24 extends along the longitudinal edges 14, 16 a sufficient length to ensure closure of the ends. Ordinarily, the means for releasably joining extends substantially along the entire length of the edges 14, 16, as shown.

The means 26 for tightening the lower edge of the first piece 11 toward a central point, ordinarily, comprises a band of elasticized material. The band may be of varying width and is attached to the lower edge of the first piece by any suitable means such as sewing, gluing or heat treatment. The elastic band is of length which would fit closely but not snugly around the average human neck. The elastic band at the base of the hooded garment prevents the garment from pulling up over the face during dressing when clothing is pulled on or off over the head.

The garment may be decorated in any appropriate fashion. For example, ribbon, lace or appliques may be applied to the garment.

The hood-type garment is worn by placing the top of the garment over the top of the head of a user drawing the body of the hood 12 around the face and head and closing the fastening means 24 to enclose the head and face within the hood-type garment. The elastic lower edge 26 of the garment encircles the neck of the wearer holding the hood closely, but not snugly about the neck of the wearer. The hood-type garment provides a means for protecting a user's hair and makeup when dressing. The hood-type garment also protects clothing from being soiled by makeup or hair preparations. The means for releasably joining makes the garment practical for a person who would otherwise feel claustrophobic in a hood-type garment with a tie closure.

The garment hereof, also, provides an alternative to tie closure hood-type garments. This garment enables a handicapped person, such as a person having arthritis or a palsy who is a unable to tie a garment to utilize the zipper or Velcro® fastening means for egress and ingress, while the elasticized band maintains the positioning of the garment, when disposed about the user's neck.

Having, thus, described the invention, what is claimed is:

1. A hood-type garment for protecting hair and makeup while dressing comprising:

(a) a first rectangular piece of material having an upper edge, a lower edge and opposed ends, the ends of the material being releasably joinable to form a cylindrical shape for placement about the face and hair of a user;

(b) a second piece of material, the second piece being circular and which is secured along its circumference to the upper edge of the first piece to form a top section;

(c) means for releasably joining the opposed ends of the first piece at the point at which it is joined;

(d) means for tightening the lower edge of the first piece about the neck of a user.

2. The hood-type garment of claim 1 wherein the first and second pieces of material comprise a mesh fabric.

3. The hood-type garment of claim 1 wherein the means for releasably joining the ends of the first piece of material comprise a zipper.

4. The hood-type garment of claim 1 wherein the means for releasably joining the ends of the first piece of fabric comprises hook and loop fasteners.

5. The hood-type garment of claim 1 wherein the means for tightening the lower edge of the first piece comprises an elasticized band secured to the lower edge of the first piece of material.

6. A hood-type garment for protecting hair and makeup while dressing comprising:

(a) a first rectangular piece of mesh fabric, the rectangular piece having an upper edge, a lower edge, and opposed ends, the ends of the rectangle being releasably joinable to form a generally cylindrical shape for placement about the face and hair of a user;

(b) a circular second piece of mesh fabric which is joined along its circumference to the upper edge of first piece to form a top section;

(c) a zipper for releasably joining the opposed ends, the zipper being disposed along the length of the opposed ends;

(d) an elasticized band secured to the lower edge of the first piece of fabric and which encircles the neck of a user.

* * * * *